US005604075A

United States Patent [19]

Larson et al.

[11] Patent Number: 5,604,075

[45] Date of Patent: Feb. 18, 1997

[54] LIQUID DEVELOPER COMPOSITIONS AND PROCESSES

[75] Inventors: James R. Larson; John F. Knapp, both of Fairport; Frank J. Bonsignore, Rochester, all of N.Y.

[73] Assignee: Xerox Corporation, Stamford, Conn.

[21] Appl. No.: 554,021

[22] Filed: Nov. 6, 1995

[51] Int. Cl.[6] ..... G03G 9/12

[52] U.S. Cl. ..... 430/137; 430/115

[58] Field of Search ..... 430/112, 114, 430/115, 137

[56] References Cited

U.S. PATENT DOCUMENTS

| | | | |
|---|---|---|---|
| 4,707,429 | 11/1987 | Trout | 430/115 |
| 5,019,477 | 5/1991 | Feider | 430/115 |
| 5,030,535 | 7/1991 | Drappel et al. | 430/116 |
| 5,045,425 | 9/1991 | Swidler | 430/115 |
| 5,066,559 | 11/1991 | Elmasry et al. | 430/111 |
| 5,308,731 | 5/1994 | Larson et al. | 430/115 |
| 5,455,315 | 10/1995 | Paine et al. | 430/109 |

*Primary Examiner*—John Goodrow
*Attorney, Agent, or Firm*—E. O. Palazzo

[57] ABSTRACT

A process for the preparation of liquid developers with reduced fines which comprises heating a liquid developer comprised of thermoplastic resin, pigment, charge adjuvant, liquid hydrocarbon, and optional charge director, wherein said heating is accomplished at about 5° C. below the melting point of said thermoplastic resin, which heating enables said fines comprised of said developer components, and of a size diameter of from about 0.1 to about 0.4 micron to be reduced.

31 Claims, No Drawings

LIQUID DEVELOPER COMPOSITIONS AND PROCESSES

BACKGROUND OF THE INVENTION

This invention is generally directed to liquid developer compositions and, more specifically, to high speed electrophotographic imaging and printing systems with liquid developers wherein the number of particles thereof that are less than or equal to about 0.4 micron in size, such as average volume diameter, are reduced. More specifically, in embodiments the present invention relates to imaging processes wherein liquid developers contain less than about 50 percent of particles that are less than or equal to 0.5 micron in size, and which particles are considered difficult to remove from, for example, the background areas. Also, the present invention relates to processes for the preparation of liquid developers with a reduced number of small particles by heating the developer, or more preferably the toner comprised of thermoplastic resin, pigment, and charge adjuvant to about 5° C. below the melting point of the thermoplastic resin contained in a hydrocarbon fluid. In embodiments, the liquid toner is comprised of a fluid of low vapor concentration and high viscosity, thermoplastic resin, pigment and charge adjuvant, and the liquid developer thereof contains in addition to the aforementioned components a charge director. A number of charge directors can be selected as indicated herein including ALOHAS, those derived from alkylation or protonation of poly-2-ethylhexylmethacrylate-co-N',N'-dimethylamino-2-ethylmethacrylate (EHMA-DMAEMA) A-B diblock copolymers, which form inverse micelies with the ammonium ionic or polar end of the block copolymer faced inward, and the nonpolar EHMA tail pointing in a direction outward toward the hydrophobic hydrocarbon vehicle selected for the liquid developer; and wherein the molecular weight distribution of the charge director is bimodal comprising a component with a number average molecular weight (determined by dividing the number of moles of monoinitiator into the number of grams of acrylic monomer being initiated by the charged molar quantity of monoinitiator) of from about 70,000 to about 200,000, preferably from about 80,000 to about 150,000, and more preferably about 85,000 to about 100,000, and a second component with a number average molecular weight of from about 2,200 to about 60,000, preferably from about 3,000 to about 20,000, and more preferably from about 4,000 to 10,000. Effective ratios of the high $M_n$ (number average molecular weight) over the low $M_n$ components range from 99/1 to 10/90 with a preferred range being 95/5 to 50/50. With the aforementioned molecular weight distribution, there are enabled liquid developers with a number of advantages such as high particle charge with a controlled range of low conductivities. The low conductivities result from the larger micelies which result from the high molecular weight component of the charge director. The large micelle reduces the conductivity in, for example, as follows: 1) the electrophoretic mobility is reduced as the size of the micelle increases due to viscous drag; and 2) as the size of the micelle increases, the number of micelies decreases at the same total mass loading of the charge director resulting in a decrease in the micelle charge density. Furthermore, it has been shown that these charge directors with selected molecular weight distributions result in low conductivity liquid toner dispersions with stable high particle charge over a range in low conductivities. For example, the charge director with the selected bimodal molecular weight distributions result in particle mobilities which vary from about 2.6 to 2.8 E-10 $m^2/Vs$ over a conductivity (of 1 percent solids liquid toner dispersion) of from about 2 to 8 ps/centimeter. In contrast, the use of a low molecular weight monomodal molecular weight distribution charge director results in a mobility variation of about 0.2 to 2.5 E-10 $m^2/Vs$ over the same conductivity range.

The developers of the present invention can in embodiments be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate, and can also lead to image defects such as smears and hollowed fine features. To overcome or minimize such problems, the liquid toners of the present invention were arrived at after substantial research efforts, and which toners result in, for example, sufficient particle charge for transfer and maintain the mobility within the desired range of the particular imaging system employed. Especially of importance to the present invention is the use of liquid developers wherein the toner or solids thereof have a reduced number of particles, for example about 50 percent or less, such as from about 10 to 50 percent, that are equal or less than about 0.5 micron.

A latent electrostatic image can be developed with toner particles comprised of resin, pigment, and charge adjuvant dispersed in an insulating nonpolar liquid. The aforementioned dispersed materials are known as liquid toners or liquid developers. A latent electrostatic image may be generated by providing a photoconductive layer with a uniform electrostatic charge, and subsequently, discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Useful liquid developers can comprise a thermoplastic resin, colorant like pigment or dye, and a dispersant nonpolar liquid. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns (μm) average by area size as measured by the Horiba CAPA 500 or 700 particle sizers. However, these and other liquid toners contain a large percentage of solid particles that are equal to or greater than 0.5 micron in size, for example usually more than 50 percent of such particles, a disadvantage avoided with the present invention.

The formation of images depends, for example, on the difference of the charge between the toner particles in the liquid developer and the latent electrostatic image to be developed. It has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors may include both negative charge directors, such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography, which comprises as main components a coloring component and a binder resin, which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer, and the compatible segment thereof is oriented to be compatible with other resins and a coloring agent contained in the toner whereby the toner is provided with both liquid repelling and solvent soluble properties.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009 and 5,034,299.

The disclosures of each of the U.S. patents mentioned herein are totally incorporated herein by reference.

In copending patent application U.S. Ser. No. 986,316, the disclosure of which is totally incorporated herein by reference, there is illustrated a process for forming images, which comprises (a) generating an electrostatic latent image; (b) contacting the latent image with a developer comprising a colorant and a substantial amount of a vehicle with a melting point of at least about 25° C., which developer has a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. No. 5,306,591, there is disclosed a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

In U.S. Pat. No. 5,407,775, the disclosure of which is totally incorporated herein by reference, there is illustrated a liquid developer comprised of a liquid, thermoplastic resin particles, a nonpolar liquid soluble charge director comprised of a zwitterionic quaternary ammonium block copolymer wherein both cationic and anionic sites contained therein are covalently bonded within the same polar repeat unit in the quaternary ammonium block copolymer.

In U.S. Pat. No. 5,459,007 the disclosure of which is totally incorporated herein by reference, there is illustrated a liquid developer comprised of a liquid, thermoplastic resin particles, a nonpolar liquid soluble charge director comprised of an ionic or zwitterionic quaternary ammonium block copolymer ammonium block copolymer, and wherein the number average molecular weight thereof of said charge director is from about 70,000 to about 200,000.

The components of the above U.S. patents and patent applications, the disclosures of which are totally incorporated herein by reference, can be selected for the liquid developers and processes of the present invention in embodiments thereof.

SUMMARY OF THE INVENTION

It is an object of the present invention to provide liquid developers and processes thereof with many of the advantages illustrated herein including, for example, the substantial nonvolatility and lower vapor pressure of the hydrocarbon fluid, and wherein the number of particle fines, such as 0.4 micron or less, are reduced thereby minimizing undesirable background development.

Another object of the present invention is to provide liquid developers capable of high particle charging and fast toner charging rates, and wherein the number of particles with a size of about 0.4 micron are decreased.

In another object of the present invention there are provided high speed, for example greater than 100 copies per minute and up to 150 copies per minute, xerographic printing processes, including color processes and lithography, and wherein the number of solid particles with a size of about 0.4 micron are decreased about at least 50 percent as compared to present liquid developers.

Further, another object of the present invention is to provide liquid developer with high particle charges and low conductivities.

Another object of the invention is to provide a negatively charged liquid developer wherein there is selected as charge directors ionic and/or zwitterionic ammonium AB diblock copolymers, and which copolymer has an important molecular weight distribution which is bimodal comprising an AB diblock component with a number average molecular weight (determined by dividing the number of moles of monoinitiator into the number of grams of acrylic monomer being initiated by the charged molar quantity of monoinitiator) is from about 70,000 to about 200,000, preferably from about 80,000 to about 150,000, and more preferably about 85,000 to about 100,000, and a second AB diblock component with a number average molecular weight $M_n$ is from about 2,200 to about 6,000, preferably from about 3,000 to about 20,000, and more preferably about 4,000 to 10,000, and wherein the number of solid particles with a size of about 0.4 micron are decreased about at least 50 percent as compared to present liquid developers. Effective ratios of the high $M_n$ over the low $M_n$ components range from 99/1 to 10/90, with a preferred range of 95/5 to 50/50, wherein A is considered the polar ionic block like an ammonium containing segment and B is considered the nonpolymer block like 2-ethylhexylmethacrylate. Examples of acceptable conductivity and mobility ranges for developers charged with the bimodal molecular weight distribution charge directors of this invention are illustrated herein. Conductivities measured at ambient temperature (21° C. to 23° C.) for developers containing one percent toner solids are considered high in the 10 to 20 pmhos/centimeter range and very high at greater than 20 pmhos/centimeter. Optimum conductivities are less than about 10 pmhos/centimeter and preferably less than about 5 ps/centimeter. As conductivities increase above the optimum range, excess ions can compete with toner particles of the same charge for development of the latent image giving rise to low developed mass resulting in low print density images. In addition to having an optimum conductivity of less than 10 pmhos/centimeters, the liquid toner or developer of this invention also possesses a mobility of at least $-1.5\times10^{10}$ $m^2/Vs$ and preferably greater than $-2.5\times10^{-10}$ $m^2/Vs$ in embodiments.

It is still a further object of the invention to provide a liquid developer wherein developed image defects, such as smearing, loss of resolution and loss of density, are eliminated, or minimized, and wherein the number of solid particles with a size of about 0.4 micron are decreased about at least 50 percent as compared to present liquid developers.

Another object of the present invention relates to processes for the preparation of liquid toners wherein the number of solid particles with a size of about 0.4 micron are decreased about at least 50 percent as compared to present liquid toners, which processes comprise heating the toner to below about 5° C. below the melting point of the thermoplastic resin contained in the hydrocarbon fluid of the developer, and wherein the aforementioned melting point is, for example, from about 40° C. to about 72° C., preferably from about 47° C. to about 71° C., and more preferably about 72° C.

It is another object of the invention to provide low conductivity liquid developers, which will be effective in an image-on-image xerographic printing process where an image is developed on a latent image bearing member in the xerographic process, and then that image bearing member is passed through the xerographic charging, imagewise discharging, and development steps to develop a multilayered image. The subsequent development steps can be accomplished with liquid toner dispersions of colors different than the first or previous development resulting in a multicolored image which can be transferred from an imaging member to a substrate.

Also, in another object of the present invention there are provided negatively charged liquid developers, wherein the number of solid particles with a size of about 0.4 micron are decreased about at least 50 percent as compared to present liquid developer, with certain bimodal molecular weight distribution ionic and/or zwitterionic ammonium AB diblock copolymer charge directors, which are superior in embodiments to, for example, monomodal molecular weight distribution ammonium block copolymers since, for example, the bimodal directors result in high negative toner particle charge over a wider range of low conductivity. For example, the charge director with the selected bimodal molecular weight distributions results in particle mobilities which vary from 2.6 to 2.8 $E^{-10}$ $m^2/Vs$ over a conductivity (of 1 percent solids liquid toner dispersion) of from 2 to 8 ps/centimeter. In contrast, the use of a low molecular weight monomodal molecular weight distribution charge director results in a mobility variation of 0.2 to 2.5 $E^{-10}$ $m^2/Vs$ over the same conductivity range.

Another object of the present invention resides in processes for liquid developers wherein the number of particles that are about 0.5 micron, or less in size is less than about 50 percent, and in embodiments is from about 10 to about 50 percent, which developers may be selected for lithography, and wherein these developers enable reduced, or minimal background developmental levels.

Moreover, in another object of the present invention there are provided liquid developers and processes thereof wherein the majority of the toner particles comprised, for example, of resin, pigment, and charge additive contain substantially no toner below about 0.4 micron in average diameter, and wherein the processes involve heating the toner in a selected hydrocarbon fluid, such as ISOPAR®, to about 5° C. below the melting point of the thermoplastic resin of the liquid developer, and whereby reducing, or minimizing the aforementioned fines permits control of the image background by, for example, adjusting the image bias.

These and other objects of the present invention can be accomplished in embodiments by the provision of liquid developers. In embodiments, the present invention is directed to liquid developers comprised of a liquid, toner resin, pigment, charge additive and a charge director, and wherein the number of solid particles with a size of about 0.4 micron, and preferably about 0.5 micron are substantially removed, or decreased about at least 50 percent as compared to present liquid developers. Also, the present invention relates to processes for the preparation of the aforementioned toners by, for example, heating the toner to from about 50° C. to about 60° C., followed by cooling to room temperature, about 25° C.

In embodiments, the present invention relates to an imaging process which comprises forming a latent image; developing the image with a licuid developer comprised of a liquid component, thermoplastic resin particles, pigment, charge adjuvant and charge director; transferring the developed image to a substrate and optionally fixing the image thereto, and wherein the number of solids of resin, pigment and charge adjuvant with a size of less than about 0.5 micron, and preferably 0.4 micron in average volume diameter, is from about 10 to about 50 percent; an imaging process which comprises forming a latent image; developing the image with a liquid developer comprised of a liquid component, thermoplastic resin particles, pigment, charge adjuvant and charge director; transferring the developed image to a substrate and fixing the image thereto, and wherein the number of solids of resin, pigment and charge control agent with a size in average volume diameter of from about 0.1 to about 0.5 micron is from about 20 to about 45 percent; a process for the preparation of a liquid toner comprised of heating said toner at a temperature of about 5° C. below the melting point of the thermoplastic resin contained in the hydrocarbon fluid present in the toner; and a process for the preparation of a liquid toner comprised of heating a liquid toner comprised of thermoplastic resin particles, pigment, charge control agent, and hydrocarbon fluid at a temperature of about 5° C. below the melting point of the thermoplastic resin particles contained in the hydrocarbon fluid.

Embodiments of the present invention relate to a developer comprised of a liquid, thermoplastic resin particles, and a nonpolar liquid soluble ammonium block copolymer charge director; and a liquid electrostatographic developer comprised of (A) a nonpolar liquid having a Kauri-butanol value of from about 5 to about 30, and present in a major amount of from about 50 percent to about 95 weight percent; (B) thermoplastic resin particles having an average volume particle diameter of from about 5 to about 30 microns; (C) a nonpolar liquid soluble bimodal molecular weight distribution ionic or zwitterionic ammonium block copolymer; and (D) optionally a charge control/charge adjuvant agent, and wherein the number of solid particles of resin, pigment, and charge control agent with a size of about 0.4 micron, and preferably about 0.5 micron or less are decreased by about at least 50 percent, and, for example, from about 10 to about 45 percent, as compared to present liquid developers.

A number of known charge control agents/charge adjuvants, such as ALOHAS, hydroxy bis(3,5-tertiary butyl salicylic)-aluminate monohydrate; the charge adjuvants as illustrated in U.S. Pat. Nos. 5,306,591 and 5,308,731, such as aluminum hydroxy carboxylic acids, and known charge directors can be selected for the liquid developers as illustrated in the patents and copending applications mentioned herein, and wherein the charge directors can be represented by the formula

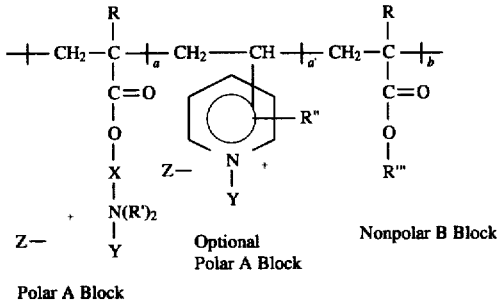

wherein R is hydrogen, alkyl, aryl, or alkylaryl; R' is alkyl, aryl, cycloalkyl, cycloalkylenyl cycloalkylalkyl, cycloalkylaryl or alkylaryl with or without heteroatoms; R" is alkyl, aryl, cycloalkyl, cycloalkylalkyl, cycloalkylaryl or alkylaryl with or without heteroatoms; R'" is alkyl, aryl, cycloalkyl, cycloalkylalkyl, cycloalkylaryl or alkylaryl of 4 to 20 carbons with or without heteroatoms; X is alkylene or arylalkylene of, for example, about 2 to 10 carbons with or without heteroatoms and Y is hydrogen, alkyl of 1 to about 25 carbon atoms; alkylaryl and aryl from 6 to about 30 carbon atoms with or without heteroatoms; Z- is an anion such as bromide, hydroxide, chloride, nitrate, p-toluenesulfonate, sulfate, phosphate, fluoride, dodecylsulfonate, dodecylbenzenesulfonate, acetate, trifluroacetate, chloroacetate, stearate, and the like. For the high molecular weight component of the bimodal molecular weight distribution, $aM_a+a'M_{a'}$ is about 3,500 to 120,000 and $bM_b$ is 28,000 to 190,000, and for the low molecular weight distribution $aM_a+a'M_{a'}$ is about 200 to 10,000 and $bM_b$ is 2,000 to 50,000 wherein a, a' and b are the number average degree of polymerization (DP) and $M_a$, $M_{a'}$ and $M_b$ are the corresponding repeat unit molecular weights. Effective ratios of the high $M_n$ over the low $M_n$ components range from 99/1 to 10/90, with a preferred range of 95/5 to 50/50. Alkyl includes groups with 1 to about 25 carbon atoms; aryl includes groups with from 6 to about 24 carbon atoms, and alkylene can include groups with from 1 to about 25 carbon atoms.

Examples of specific diblock copolymer charge directors include poly[2-trimethylammoniumethyl methacrylate bromide co-2-ethylhexyl methacrylate], poly[2-triethylammoniumethyl methacrylate hydroxide co-2-ethylhexyl methacrylate], poly[2-trimethylammoniumethyl methacrylate chloride co-2-ethylhexyl methacrylate], poly[2-trimethylammoniumethyl methacrylate fluoride co-2-ethylhexyl acrylate], poly[2-trimethylammoniumethyl acrylate p-toluenesulfonate co-2-ethylhexyl methacrylate], poly[2-trimethylammoniumethyl acrylate nitrate co-2-ethylhexyl acrylate], poly[2-triethylammoniumethyl methacrylate phosphate co-2-ethylhexyl acrylate], poly[2-triethylammoniumethyl acrylate bromide co-2-ethylhexyl acrylate], poly [2-trimethylammoniumethyl methacrylate hydroxide co-2-ethylhexyl acrylate], poly[2-trimethylammoniumethyl acrylate hydroxide co-2-ethylhexyl acrylate], poly[2-trimethylammoniumethyl methacrylate hydroxide co-N,N-dibutyl methacrylamide], poly[2-triethylammoniumethyl methacrylate chloride co-N,N-dibutyl methacrylamide], poly[2-trimethylammoniumethyl methacrylate bromide co-N,N-dibutylacrylamide], poly[2-triethylammoniumethyl methacrylatehydroxide co-N,N-dibutylacrylamide], poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate, poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], and poly[2-dimethylammoniumethyl methacrylate tosylate co-N,N-dibutylacrylamide].

The charge director can be selected for the liquid developers in various effective amounts, such as for example from about 0.5 percent to 100 percent by weight relative to developer solids and preferably 1 percent to 20 percent by weight relative to developer solids. Developer solids includes toner resin, pigment, and charge adjuvant. Without pigment, the developer may be selected for the generation of a resist, or a printing plate. Effective ratios of the high $M_n$ over the low $M_n$ components range from 99/1 to 10/90, with a preferred range of 95/5 to 50/50.

Examples of liquid carriers or vehicles selected for the developers of the present invention include a liquid with viscosity of from about 0.5 to about 500 centipoise, and preferably from about 1 to about 20 centipoise, and a resistivity greater than or equal to $5\times10^9$ ohm/centimeters, such as $10^{13}$ ohm/centimeter, or more. Preferably, the liquid selected in embodiments is a branched chain aliphatic hydrocarbon. A nonpolar liquid of the ISOPAR® series available from the Exxon Corporation may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR® series available from Exxon Corporation, the SOLTROL® series available from the Phillips Petroleum Company, and the SHELLSOL® series available from the Shell Oil Company can be selected. Other useful liquids include mineral oils such as the SUPURLA® series available from the Amoco Oil Company.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX® resins, E.I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid; and at least one alkyl ester of acrylic or methacrylic acid wherein alkyl is from 1 to about 20 carbon atoms like methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL® like NUCREL 599®, NUCREL 699®, or NUCREL 960® can be selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference.

To increase the toner particle charge and, accordingly, increase the mobility and transfer latitude of the toner particles, charge adjuvants can be added to the toner. For example, adjuvants, such as metallic soaps like aluminum or magnesium stearate or octoates, fine particle size oxides, such as oxides of silica, alumina, titania, and the like, paratoluene sulfonic acid, and polyphosphoric acid may be added. Negative charge adjuvants increase the negative charge of the toner particle, while the positive charge adjuvants increase the positive charge of the toner particles. With the invention of the present application, the adjuvants or charge additives can be comprised of the metal catechol and aluminum hydroxyacid complexes illustrated in U.S. Pat. No. 5,306,591 and U.S. Pat. No. 5,308,731, the disclosures of which are totally. incorporated herein by reference, and which additives in combination with the charge directors of the present invention have the following advantages over the aforementioned prior art charge additives: improved toner charging characteristics, namely an increase in particle charge, as measured by ESA mobility, from −1.4 $E^{-10}$ $m^2/Vs$ to −2.3 $E^{-10}$ $m^2/Vs$, that results in improved image development and transfer, from 80 percent to 93 percent, to allow improved solid area coverage, from transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer.

Charge control components are known, and may include those as illustrated in U.S. Pat. No. 5,366,840, the disclosure of which is totally incorporated herein by reference. More specifically, there is illustrated in this copending patent application a liquid developer comprised of thermoplastic resin particles, an optional charge director, and a charge additive or adjuvant comprised of a component of the formulas

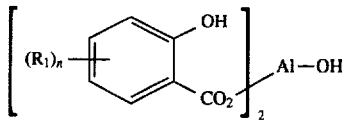

-continued or

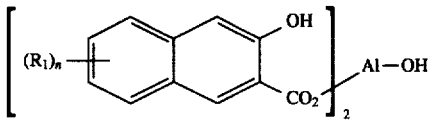

wherein $R_1$ is selected from the group consisting of hydrogen and alkyl, and n is 0 (zero), 1,2, 3, or 4, or mixtures thereof in embodiments.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions because the measurements can be made at high volume loadings, for example greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media is particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 80° C. to about 95° C., and preferably to about 90° C. followed by cooling to room temperature. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion, followed by heating as indicated herein at, for example, 50° C., and wherein the following was observed after preparation of the following liquid developer:

15 Kilograms of 2 weight percent of Mark 1 cyan ink (26788-37) prepared as follows: 4,155.1-grams of 7.22 weight percent toner with NUCREL 599® and pigment of PV FAST BLUE™ at a 20 percent loading, and wherein the charge control agent is aluminum stearate at a 3 percent loading combined with 180.0 grams of 5 weight percent of HBR Quat charge director (26715-5, 4k MW); and 10,664.9 grams of NORPAR 15® were combined and mixed with above ingredients.

This ink had the following particle size characteristics after being heated to 50° C. for 4 days, which particle size was measured by centrifugal sedimentation with a Horiba CAPA 700 particle size analyzer. The developer was heated to 50° C. by stirring it in a double walled glass vessel, and heated water from a temperature bath was circulated in the outside jacket.

| Number Average | Original (Unheated) | 50° C. |
|---|---|---|
| % < .60 | 67.2 | 58.9 |
| % < 1.0 | 83.0 | 78.3 |
| % < 2.0 | 95.6 | 94.1 |
| % < 3.0 | 99.5 | 98.5 |
| % < 4.0 | 99.8 | 99.8 |
| Volume Average | 2.33 | 2.56 |

The amount of nonpolar liquid to be added should in embodiments be an amount sufficient to decrease the total solids concentration of the dispersion to from about 10 to about 20 percent by weight. Methods for the preparation of developers that can be selected are illustrated in U.S. Pat. Nos. 4,760,009; 5,017,451; 4,923,778 and 4,783,389, the disclosures of which are totally incorporated herein by reference. Charge control components, or enhancers, and the like are illustrated in U.S. Pat. Nos. 5,306,591 and 5,308,731, the disclosures of which are totally incorporated herein by reference.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image.

The conductivity of the liquid toner dispersions and charge director solutions can be determined with a Scientifica 627 Conductivity Meter (Scientifica, Princeton, N.J.). The measurement signal for this meter is a low distortion 18 hz sinewave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of −26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA 500 and 700 centrifugal automatic particle analyzer manufactured by Horiba Instruments, Inc., Irvine, Calif.

Preparation of Mark I Toner (26788-37):

One hundred and seventy-five (175.0) grams of NUCREL 599®, a copolymer of ethylene and methacrylic acid with a melt index at 190° C. of 500 dg/minute, available from E.I. DuPont de Nemours & Company, Wilmington, DE, 45.4 grams of the cyan pigment PV FAST BLUE™, 6.8 grams of aluminum stearate WITCO 22™, available from Witco Company, and 307.4 grams of NORPAR 15®, carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 86° to 94° C. for 2 hours and cooled by running water through the attritor jacket to 20° C. An additional 980.1 grams of NORPAR 15® were added, and ground in the attritor for an additional 4.5 hours. An additional 1,515 grams of NORPAR 15® were added and the mixture was separated by the use of a metal grate from the steel balls yielding a liquid toner concentrate of 7.22 percent solids wherein solids include resin, charge adjuvant, and pigment, and 92.78 percent of NORPAR 15®. The particle diameter was 2.33 microns average by volume as measured with a Horiba CAPA 700.

Preparation of Mark II Toner (:26456-40 and 26643-50): These Two Toners Were Used to Prepare the 75 Percent of ISOPAR® V/25

Percent of NORPAR 15® Ink (26788-6):

One hundred and seventy-nine and 5 tenths (179.5) grams of NUCREL 599®, a copolymer of ethylene and methacrylic acid with a melt index at 190° C. of 500 dg/minute, available from E.I. DuPont de Nemours & Company, Wilmington, Del., 45.4 grams of the cyan pigment PV FAST BLUE™, 2.3 grams of ALOHAS, and 307.4 grams of NORPAR 15®, carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 85° to 92° C. for 2 hours and cooled by running water through the attritor jacket to 26° C. An additional 980.1 grams of NORPAR 15® were added, and ground in the attritor for an additional 4.5 hours. An additional 1,536 grams of NORPAR 15® were added and the mixture was separated by the use of a metal grate from the steel balls yielding a liquid toner concentrate of 7.00 percent solids wherein solids include resin, charge adjuvant, and pigment, and 93.0 percent of NORPAR 15®. The toner solids particle diameter was 2.33 microns average by volume as measured with a Horiba CAPA 700.

Preparation of Ink 26788-6 (72 Percent of ISOPAR V®/28 Percent of NORPAR 15®):

To 2,788.4 grams of 7.30 weight percent of the above 2.33 micron toner, 122.2 grams of 4,000 $M_w$ charge director poly[2-ethylhexyl methacrylate (B block)-co-N,N-dimethyl-N-ethyl methacrylate ammonium bromide (A block)], (26715-5) were added to effect 30 milligrams of charge director per gram of toner solids. To this mixture were added 7,244.8 grams of ISOPAR V® so that the final hydrocarbon composition of the ink was 72 percent of ISOPAR V®, 28 percent of NORPAR 15®.

One hundred and seventy-five (175.0) grams of NUCREL 599®, a copolymer of ethylene and methacrylic acid with a melt index at 190° C. of 500 dg/minute, available from E.I. DuPont de Nemours & Company, Wilmington, Del., 45.4 grams of the cyan pigment PV FAST BLUE™, 6.8 grams of aluminum stearate WITCO 22™, available from Witco Company, and 307.4 grams of NORPAR 15®, carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 86° to 96° C. for 2 hours and cooled by running water through the attritor jacket to 16° C. An additional 980.1 grams of NORPAR 15® were added, and ground in the attritor for an additional 4.5 hours. An additional 1,536 grams of NORPAR 15® were added and the mixture was separated by the use of a metal grate from the steel balls yielding a liquid toner concentrate of 7.13 percent solids wherein solids include resin, charge adjuvant, and pigment, and 92.87 percent of NORPAR 15®. The particle diameter was 2.12 microns average by area as measured with a Horiba CAPA 500.

One hundred and seventy-five (175.0) grams of NUCREL 599®, a copolymer of ethylene and methacrylic acid with a melt index at 190° C. of 500 dg/minute, available from E.I. DuPont de Nemours & Company, Wilmington, Del., 45.4 grams of the cyan pigment PV FAST BLUE™, 6.8 grams of aluminum stearate WITCO 22™, available from Witco Company, and 307.4 grams of NORPAR 15®, carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 84° to 95° C. for 2 hours and cooled by running water through the attritor jacket to 21° C. An additional 980.1 grams of NORPAR 15® were added, and ground in the attritor for an additional 4.5 hours. An additional 1,500 grams of NORPAR 15® were added and the mixture was separated by the use of a metal grate from the steel balls yielding a liquid toner concentrate of 7.27 percent solids wherein solids include resin, charge adjuvant, and pigment and 92.73 percent of NORPAR 15®. The particle diameter was 1.76 microns, average by area as measured with a Horiba CAPA 700.

Cyan liquid toner dispersions were prepared by selecting 27.51 grams of liquid toner concentrate (7.27 percent solids in NORPAR 15®) and adding to it sufficient NORPAR 15® and 5 percent low and high molecular weight (charged $M_n$ of 3,945 and 93,519, respectively) protonated ammonium bromide AB diblock charge director, poly[2-ethylhexyl methacrylate (B block)-co-N,N-dimethyl-N-ethyl methacrylate ammonium bromide (A block)], to provide 1 percent solids wherein solids include resin, charge adjuvant, and pigment liquid toner dispersions containing a total of 100 milligrams or 10 percent charge director per gram of toner solids in various blend weight ratios with, for example, the 5 percent low molecular weight after 1, 7, 28 and 165 days of equilibration, the measured mobility and conductivity were excellent for these 1 percent liquid toners, and the toner charging rate and level were also excellent enabling developed images with substantially no background deposits.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of liquid developers with reduced fines consisting essentially of heating a liquid developer comprised of thermoplastic resin, pigment, charge adjuvant, liquid hydrocarbon, and optional charge director, wherein said heating is accomplished at about 5° C. below the melting point of said thermoplastic resin, which heating enables said fines comprised of said developer components, and of a size diameter of from about 0.1 to about 0.4 micron to be reduced.

2. A process in accordance with claim 1 wherein the thermoplastic resin melting temperature in the presence of said liquid hydrocarbon is about 72° C.

3. A process in accordance with claim 1 wherein the thermoplastic resin melting temperature in the presence of said hydrocarbon is from about 71° C. to about 47° C.

4. A process in accordance with claim 1 wherein said developer components of a size diameter of from about 0.1 to about 0.4 micron are reduced at least about 50 percent.

5. A process in accordance with claim 1 wherein said developer components of a size diameter of from about 0.1 to about 0.4 micron are reduced from about 10 to about 50 percent, and said thermoplastic melting temperature is from about 45° C. to about 70° C.

6. A process in accordance with claim 4 wherein said size diameter is about 0.4 micron.

7. An imaging process which comprises forming a latent image; developing the image with a liquid developer comprised of a liquid component, thermoplastic resin particles, pigment, charge adjuvant and charge director; transferring the developed image to a substrate and optionally fixing the image thereto; and wherein the number of solids of resin, pigment and charge adjuvant with a size of less than about 0.5 micron is from about 50 to about 90 percent.

8. A process in accordance with claim 7 wherein the solids with a size of less than about 0.5 micron is reduced at least 50 percent by heating said solids about 5° C. below the melting point of said thermoplastic resin.

9. A process in accordance with claim 8 wherein said size is from about 0.1 to about 0.4 micron, and the softening temperature of said thermoplastic resin is from about 65° C. to about 100° C.

10. A process in accordance with claim 1 wherein the number of said developer component solids of resin, pigment and charge adjuvant with a size in average volume diameter of from about 0.1 to about 0.5 micron is reduced from about 20 to about 45 percent.

11. A process in accordance with claim 7 wherein the number of solids of resin, pigment and charge adjuvant with a size in average volume diameter of from about 0.1 to about 0.5 micron is reduced from about 20 to about 45 percent.

12. A process in accordance with claim 7 wherein said liquid developer is comprised of (A) a nonpolar liquid having a Kauri-butanol value of from about 5 to about 30 and present in a major amount of from about 50 percent to about 95 weight percent; (B) thermoplastic resin particles and pigment particles; (C) a charge director; and (D) a charge adjuvant; and wherein the number of solids of resin, pigment and charge adjuvant with a size of about 0.4 micron is less than about 50 percent.

13. A process in accordance with claim 1 wherein the charge director is of the formula

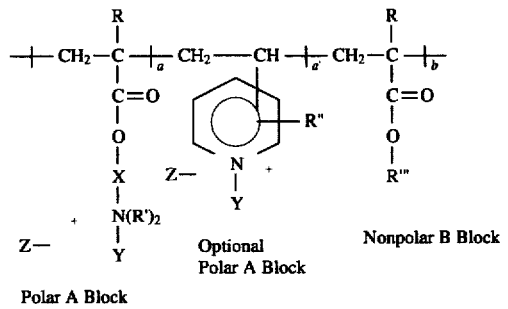

wherein R is hydrogen, alkyl, aryl, or alkylaryl; R" is alkyl, aryl, cycloalkyl, cycloalkylalkyl, cycloalkylaryl or alkylaryl with or without heteroatoms; R'" is alkyl, aryl, cycloalkyl, cycloalkylalkyl, cycloalkylaryl or alkylaryl of 4 to 20 carbons with or without heteroatoms; X is alkylene or arylalkylene of, for example, about 2 to 10 carbons with or without heteroatoms; and Y is hydrogen, or alkyl of 1 to about 25 carbon atoms; alkylaryl and aryl from 6 to about 30 carbon atoms with or without heteroatoms; Z is the anion bromide, hydroxide, chloride, nitrate, p-toluenesulfonate, sulfate, phosphate, fluoride, dodecylsulfonate, dodecylbenzenesulfonate, acetate, trifluoroacetate, chloroacetate, or stearate; $aM_a+a'M_{a'}$ is about 3,500 to 120,000 and $bM_b$ is about 28,000 to about 190,000 wherein a, a' and b are the number average degree of polymerization (DP) and $M_a$, $M_{a'}$ and $M_b$ represent the corresponding repeat unit molecular weights.

14. A process in accordance with claim 1 wherein the charge adjuvant is aluminum stearate.

15. A process in accordance with claim 1 wherein the resin is comprised of a copolymer of ethylene and an α,β-ethylenically unsaturated acid selected from the group consisting of acrylic acid and methacrylic acid, or mixtures thereof.

16. A process in accordance with claim 2 wherein the pigment is cyan, magenta, yellow, red, green, blue, brown, or mixtures thereof; or carbon black.

17. A process in accordance with claim 12 wherein component (A) is present in an amount of from about 85 percent to about 99.9 percent by weight based on the total weight of the developer solids of resin, pigment, and charge adjuvant which is present in an amount of from about 0.1 percent to about 15 percent by weight; component (C) is present in an amount of from about 0.5 percent to about 100 percent of the developer solids comprised of resin, pigment, and charge adjuvant; and component (D) is present in an amount of about 0.1 to about 40 percent by weight based on the total weight of developer solids.

18. A process in accordance with claim 1 wherein the liquid hydrocarbon is an aliphatic hydrocarbon comprised of a mixture of branched hydrocarbons with from about 12 to about 16 carbon atoms.

19. A process in accordance with claim 1 wherein said developer possesses a high developer toner charge thereby enabling developer particle mobilities that range from about 2.0 $E^{-10}$ $m^2$/vs to about 5.0 $E^{-10}$ $m^2$/vs.

20. A process in accordance with claim 1 wherein said developer possesses a low conductivity of from about 1 ps/centimeter to about 5 ps/centimeter.

21. A process for the preparation of a liquid toner consisting essentially of heating a liquid toner comprised of thermoplastic resin particles, pigment, charge adjuvant and hydrocarbon fluid at a temperature of about 5° C. below the melting point of the thermoplastic resin contained in the hydrocarbon fluid, wherein the number of solids of resin, pigment and charge adjuvant with a size of at least about 0.4 micron is about 50 percent.

22. A process in accordance with claim 21 wherein the heating is from about 50° to about 60° C. followed by cooling.

23. A process in accordance with claim 22 wherein the cooling is to about 25° C.

24. A process in accordance with claim 21 is reduced at least about 50 percent.

25. A process in accordance with claim 21 wherein the number of solids of resin, pigment and charge adjuvant with a size of from about 0.1 to about 0.4 micron is about 50 percent.

26. A process in accordance with claim 21 wherein the number of solids or fines of resin, pigment and charge adjuvant with a size diameter of from about 0.1 to about 0.4 micron is reduced from about 10 to about 50 percent.

27. A process for the preparation of liquid developers with reduced fines which comprises heating a liquid developer comprised of thermoplastic resin, pigment, charge adjuvant, liquid hydrocarbon, and optional charge director, wherein said heating is accomplished at about 5° C. below the melting point of said thermoplastic resin, which heating enables said fines comprised of said developer components, and of a size diameter of from about 0.1 to about 0.4 micron to be reduced; and subsequently adding to said developer a charge director.

28. A process for the preparation of liquid developers with reduced fines consisting of heating a liquid developer comprised of thermoplastic resin, pigment, charge adjuvant, liquid hydrocarbon, and optional charge director, wherein said heating is accomplished at about 5° C. below the melting point of said thermoplastic resin, which heating enables said fines comprised of said developer components, and of a size diameter of from about 0.1 to about 0.4 micron to be reduced.

29. A process in accordance with claim 28 wherein subsequent to said heating at a temperature of about 5° C. below the melting point there is added to said developer a charge director.

30. A process in accordance with claim 28 wherein said heating is at a temperature of from about 86° C. to about 94° C.

31. A process in accordance with claim 28 wherein said heating is at a temperature of from about 85° C. to about 92° C.

* * * * *